US009567925B2

(12) United States Patent
Nilsson et al.

(10) Patent No.: US 9,567,925 B2
(45) Date of Patent: Feb. 14, 2017

(54) DETERMINING OUTGASSING OF A FUEL FROM A LUBRICANT WITHIN AN INTERNAL COMBUSTION ENGINE AND LAMBDA VALUE ADAPTATION BASED ON THE DETERMINED OUTGASSING OF FUEL

(75) Inventors: Lars Nilsson, Nürnberg (DE); Sebastian Viehöver, Regensburg (DE); Jan-Richard Lenk, Regensburg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 529 days.

(21) Appl. No.: 13/884,979

(22) PCT Filed: Nov. 2, 2011

(86) PCT No.: PCT/EP2011/069204

§ 371 (c)(1),
(2), (4) Date: Jul. 22, 2013

(87) PCT Pub. No.: WO2012/062626

PCT Pub. Date: May 18, 2012

(65) Prior Publication Data

US 2013/0297184 A1 Nov. 7, 2013

(30) Foreign Application Priority Data

Nov. 11, 2010 (DE) ..... 10 2010 043 780

(51) Int. Cl.
*F02D 41/00* (2006.01)
*F01M 13/00* (2006.01)
(Continued)

(52) U.S. Cl.
CPC ..... *F02D 41/003* (2013.01); *F01M 13/00* (2013.01); *F02D 41/0025* (2013.01);
(Continued)

(58) Field of Classification Search
USPC ..... 701/103; 73/31.05
See application file for complete search history.

(56) References Cited

U.S. PATENT DOCUMENTS 5,331,940 A 7/1994 Takayama ..... 123/679
6,895,934 B2 5/2005 Kirschke et al. ..... 123/434
(Continued)

FOREIGN PATENT DOCUMENTS

CN 1549892 A 11/2004 ..... F02D 41/14
DE 10140987 B4 3/2003 ..... F01M 13/00
(Continued)

OTHER PUBLICATIONS

International Search Report and Written Opinion, Application No. PCT/EP2011/069204, 18 pages, Mar. 14, 2012.
(Continued)

*Primary Examiner* — Stephen K Cronin
*Assistant Examiner* — Joshua A Campbell
(74) *Attorney, Agent, or Firm* — Slayden Grubert Beard PLLC

(57) ABSTRACT

A method for determining the quantity of outgassing of a fuel from a lubricant located in an intake section housing of an internal combustion engine may include (a) setting a first coil current through the housing, (b) measuring a first output value of a lambda controller, (c) setting a second coil current through the housing, the second coil current having a different current strength than the first coil current, (d) measuring a second output value of the lambda controller and (e) determining the quantity of outgassing of the fuel based on the measured first and second output values. In addition, a method for adapting a lambda value for a fuel/air mixture to be burnt in an internal combustion engine during a lower load range may include the above-mentioned method of determining the quantity of outgassing of a fuel.

10 Claims, 4 Drawing Sheets

(51) Int. Cl.
*F02M 25/06* (2016.01)
*F02D 41/04* (2006.01)
*F02D 41/14* (2006.01)

(52) U.S. Cl.
CPC ..... *F02M 25/06* (2013.01); *F02D 41/047* (2013.01); *F02D 41/1454* (2013.01); *F02D 2250/08* (2013.01); *F02D 2250/11* (2013.01)

(56) References Cited

U.S. PATENT DOCUMENTS

| | | | | |
|---|---|---|---|---|
| 7,311,094 | B2 * | 12/2007 | Mallebrein | F02D 19/12 123/572 |
| 7,996,141 | B2 | 8/2011 | Pache et al. | 701/103 |
| 8,333,179 | B2 | 12/2012 | Mallebrein et al. | 123/698 |
| 8,505,518 | B2 | 8/2013 | Mallebrein et al. | 123/572 |
| 2001/0032637 | A1 | 10/2001 | Grieve et al. | 123/674 |
| 2009/0133678 | A1 * | 5/2009 | Mallebrein | F02D 41/047 123/679 |
| 2013/0297184 | A1 * | 11/2013 | Nilsson | F01M 13/00 701/103 |

FOREIGN PATENT DOCUMENTS

| | | | | |
|---|---|---|---|---|
| DE | 10222808 | A1 | 11/2003 | F02D 41/00 |
| DE | 102006041686 | A1 | 11/2007 | F02D 41/06 |
| DE | 102007042408 | A1 | 3/2009 | F01M 5/04 |
| DE | 102007046489 | B3 | 5/2009 | F02D 45/00 |
| DE | 102008002721 | A1 | 12/2009 | F01M 11/10 |
| WO | 2005/080775 | A1 | 9/2005 | F02D 19/12 |
| WO | 2010/040600 | A2 | 4/2010 | F01M 13/00 |
| WO | 2012/062626 | A1 | 5/2012 | F01M 13/00 |

OTHER PUBLICATIONS

Chinese Office Action, Application No. 201180054260.1, 12 pages, Feb. 13, 2015.

* cited by examiner

DETERMINING OUTGASSING OF A FUEL FROM A LUBRICANT WITHIN AN INTERNAL COMBUSTION ENGINE AND LAMBDA VALUE ADAPTATION BASED ON THE DETERMINED OUTGASSING OF FUEL

CROSS-REFERENCE TO RELATED APPLICATIONS

This application is a U.S. National Stage Application of International Application No. PCT/EP2011/069204 filed Nov. 2, 2011, which designates the United States of America, and claims priority to DE Application No. 10 2010 043 780.8 filed Nov. 11, 2010, the contents of which are hereby incorporated by reference in their entirety.

TECHNICAL FIELD

The present disclosure relates generally to the technical field of lambda value control in an internal combustion engine. The present disclosure relates, for example, to a method for determining the quantity of outgassing of fuel from a lubricant, which is located in a housing of an internal combustion engine, into an intake section of the internal combustion engine. In addition, the present disclosure relates to a method for adapting a lambda value for a fuel/air mixture which is to be burnt in an internal combustion engine during a lower load range and, in particular, during an idling mode. Furthermore, the present disclosure relates to an internal combustion engine having a control device which is configured to carry out the abovementioned methods.

BACKGROUND

Modern spark ignition engines, in particular direct injection engines, exhibit increased input of fuel into the oil sector of the crank casing. The proportion of this input of fuel will increase further in future because ethanol is increasingly added to the liquid fuel to be used for refueling and is comparatively volatile and can also penetrate seals. At present, it is planned, at least in Germany, to increase the proportion of ethanol in the fuel from the current 5% to 25%.

This input of fuel has an adverse effect on the service life of the engine oil and also impairs the lubrication capability of the engine oil. For this reason, in addition to reducing the input, attempts are made, above all, to remove the fuel from the oil again as quickly as possible. This is done by means of a venting valve in the crank housing, which venting valve permits the fuel vaporized from the hot engine oil to flow directly into the intake section and therefore into the cylinder. This also prevents the vaporized fuel from being output unburnt into the surroundings. In order to increase the corresponding scavenging current, relatively large engines in particular have not only the venting medium but also a ventilation medium which sucks fresh air from the surroundings into the crank chamber. This air flows past the oil sump and then into the intake section. The proportion of fuel in this scavenging current flowing into the intake section will be referred to below as the outgassing of fuel.

High scavenging currents together with a high proportion of, to a certain extent, sudden outgassing of the fuel (depending on the temperature of the engine oil) can lead to errors in the composition of the fuel/air mixture. In the case of extremely large errors, misdiagnoses can occur in the fuel system diagnosis or even engine stallings. In this context, the risk of engine stallings is particularly high if the engine is in the idling mode or if the engine is changing from relatively high rotational speed into the idling mode. Even in the case of a so-called hot start, in which the engine is warmed up, shut down and started again with a warm engine, outgassing of fuel can lead to the engine not being able to be started.

SUMMARY

One embodiment provides a method for determining the quantity of outgassing of a fuel from a lubricant, which is located in a housing of an internal combustion engine, into an intake section of the internal combustion engine, the method comprising: setting a first scavenging current through the housing, measuring a first output value of a lambda controller of the internal combustion engine, setting a second scavenging current through the housing, wherein the second scavenging current has a different flow strength compared to the first scavenging current, measuring a second output value of the lambda controller of the internal combustion engine, and determining the quantity of outgassing of a fuel based on the measured first output value and the measured second output value.

In a further embodiment, the quantity of outgassing of a fuel is determined based on a difference between the first output value and the second output value.

In a further embodiment, the second scavenging current has a flow strength of at least approximately zero.

In a further embodiment, the first scavenging current and/or the second scavenging current are/is set by means of a controllable valve.

In a further embodiment, the method further includes: determining a current capacity utilization rate of the internal combustion engine, wherein the method is carried out only if the current capacity utilization rate of the internal combustion engine is an average capacity utilization rate; and/or determining a current rotation speed of the internal combustion engine; wherein the method is carried out only if the current rotation speed of the internal combustion engine is within a medium rotational speed range.

In a further embodiment, in order to determine the quantity of outgassing of fuel a correlation characteristic diagram is used which depends, inter alia, on a mass air of flow rate of the internal combustion engine.

In a further embodiment, the first output value of the lambda controller is a mean value of a multiplicity of first individual output values which are made available by the lambda controller during a first time period within which the first scavenging current is present, and/or wherein the second output value of the lambda controller is a mean value of a multiplicity of second individual output values which are made available by the lambda controller during a second time period within which the second scavenging current is present.

In a further embodiment, the method further includes: renewed setting of the first scavenging current, measuring a further first output value of the lambda controller, renewed setting of the second scavenging current, and measuring a further second output value of the lambda controller, wherein the quantity of the outgassing of fuel is also determined based on the measured further first output value and the measured further second output value.

Another embodiment provides a method for adapting a lambda value for a fuel/air mixture which is to be burnt in an internal combustion engine during a lower load range and, in particular, during an idling mode, the method comprising: operating the internal combustion engine in a medium load range and/or in a medium rotational speed range, determining a value for the quantity of outgassing of fuel from a lubricant, which is located in a housing of an internal combustion engine, into an intake section of the internal combustion engine by means of a method as claimed in one of the preceding claims, estimating a correction value for future adaptation of the lambda value in a future operating state in which the internal combustion engine is operated in the lower load range, based on the specific value for the quantity of the outgassing of fuel, operating the internal combustion engine in the lower load range, and assigning a reliability level to the estimated correction value, and if the reliability exceeds a predefined minimum reliability, adapting the lambda value based on the estimated correction value, and if the reliability does not exceed the predefined minimum reliability: setting a third scavenging current through the housing, measuring a third output value of the lambda controller, setting a fourth scavenging current through the housing, wherein the fourth scavenging current has a different flow strength compared to the third scavenging current, measuring a fourth output value of the lambda controller, and adapting the lambda value based on the measured third output value and the measured fourth output value.

In a further embodiment, if the absolute value of the estimated correction value is lower than a predefined first threshold, adapting the lambda value involves maintaining the lambda value made available by the lambda controller for the lower load range without taking into account the outgassing of fuel.

In a further embodiment, if the absolute value of the estimated correction value is at least as high as the first threshold but lower than a predefined second threshold, the adaptation of the lambda value comprises modifying the lambda value, made available by the lambda controller for the lower load range, based on the estimated correction value.

In a further embodiment, the modification of the lambda value, made available by the lambda controller for the lower load range, based on the estimated correction value is carried out in such a way that, when the operating state of the internal combustion engine approaches the lower load range, an ever larger portion of the estimated correction value is taken into account in the adaptation of the lambda value.

In a further embodiment, if the absolute value of the estimated correction value is at least as high as the second threshold, the method also has at least partial blocking of the scavenging current through the housing.

In a further embodiment, the reliability of the estimated correction value decreases with increasing time which has passed since the execution of the method for determining the quantity of the outgassing of a fuel from the lubricant.

Another embodiment provides an internal combustion engine for a motor vehicle, the internal combustion engine having: a housing, in particular a crank casing, a ventilation system for the housing, a valve which can be actuated electrically and which is arranged on the ventilation system in such a way that a scavenging current through the crank casing can be set actively, and a control device which is configured in such a way that (a) the method described above as claimed in one of claims 1 to 8 for determining the quantity of outgassing of fuel from a lubricant, which is located in a housing of an internal combustion engine, into an intake section of the internal combustion engine, can be carried out, and/or (b) the method described above for adapting a lambda value for a fuel/air mixture which is to be burnt in the internal combustion engine during a lower load range and, in particular, during an idling mode, can be carried out.

BRIEF DESCRIPTION OF THE DRAWINGS

Exemplary embodiments will be explained in more detail below based on the schematic drawings, wherein.

DETAILED DESCRIPTION

Figure 1:
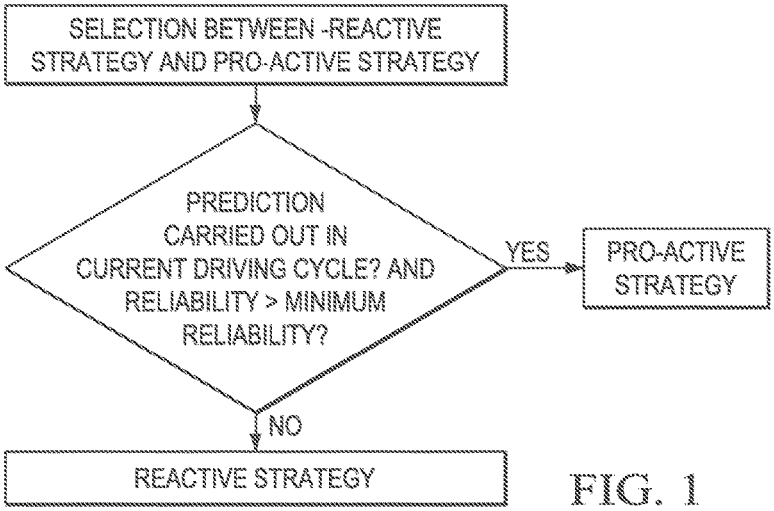
FIG. 1 shows a flowchart for selecting between a pro-active strategy and a reactive strategy for a lambda adaption with which outgassing of fuel, from a lubricant which is present in a crank casing, in an idling mode of an internal combustion engine is at least partially compensated.

Embodiments of the present disclosure may improve the stability of the operation of the engine with respect to outgassing of fuel which penetrates the intake section.

Some embodiments provide a method for determining a quantity of fuel outgassing from a lubricant, which is located in a housing of an internal combustion engine, into an intake section of the internal combustion engine is described. The described method comprises (a) setting a first scavenging current through the housing, (b) measuring a first output value of a lambda controller of the internal combustion engine, (c) setting a second scavenging current through the housing, wherein the second scavenging current has a different flow strength compared to the first scavenging current, (d) measuring a second output value of the lambda controller of the internal combustion engine and (e) determining the quantity of the outgassing of fuel based on the measured first output value and the measured second output value.

Some embodiments are based on the realization that selectively varying the strength of the scavenging current also varies the quantity of fuel which results from outgassing from the lubricant, said quantity then being introduced into the intake section of the internal combustion engine. This means that a first fuel outgassing quantity is introduced into the intake section by the first scavenging current with the first scavenging strength and a second fuel outgassing quantity is introduced into the intake section by the second scavenging current. The lambda controller of the internal combustion engine will then react to the two different fuel outgassing quantities or fuel outgassing rates in a different way by adapting its output value in order to optimize in terms of optimum combustion the lambda value of the fuel/air mixture which is to be burnt. The two resulting output values therefore constitute in combination with one another reliable information about the quantity or the rate of the fuel outgassing.

It is to be noted that in this document determination of a quantity of fuel outgassing does not necessarily require the actual mass or the actual volume of the fuel outgassing in the corresponding physical units to be determined. Instead, it is also possible to determine merely a relative value for the quantity of fuel outgassing.

According to one exemplary embodiment, the quantity of fuel outgassing is determined based on a difference between the first output value and the second output value. This has the advantage that the influence of the fuel outgassing on the mixture formation of the fuel/air mixture can be determined in a particularly easy way.

According to a further exemplary embodiment, the second scavenging current has a flow strength of at least approximately zero. This means that with the method described two states occur with respect to the scavenging of the housing containing the lubricant. In a first state the first scavenging current, which has at least a certain scavenging strength, flows through the housing. In this context, the strength of the first scavenging current can be determined, in particular, by an underpressure in the exhaust section of the internal combustion engine. In the second state, the scavenging current is interrupted or stopped by the housing or heavily throttled.

The described variation in the scavenging current can be implemented, for example, by the scavenging current being temporarily simply blocked or heavily throttled. This has the advantage that a particularly large difference can easily be brought about between the two flow strengths. As a result, the influence of the fuel outgassing on the mixture formation of the fuel/air mixture can be determined with a particularly high level of accuracy.

It is to be noted that in the case of complete stoppage of the scavenging current through the housing (for example as a result of complete closure of a ventilation valve) it is possible for fuel outgassing from the housing to be able to escape via a venting valve. This is the case, in particular, if there is a pressure in the housing which, although it can be smaller than an ambient pressure, is larger than the pressure which is present in an intake section of the internal combustion engine.

According to a further exemplary embodiment, the first scavenging current and/or the second scavenging current are set by means of a controllable valve.

The controllable valve can be mounted, for example, in or on the housing containing the lubricant, with the result that the scavenging current can easily be set in a suitable way. The valve can be, for example, a valve which can be actuated electrically, with the result that the flow strength of the scavenging current can be set by suitably applying a control signal to the controllable valve.

The valve can be a valve which can be set continuously or in various discrete steps. As a result, the flow strength can also be correspondingly set continuously or in different discrete steps. However, the valve can also simply be a "two-state valve" which is either opened completely or closed completely. The latter makes it possible to implement with a particularly low amount of expenditure on equipment the embodiment which is described above and in which the second scavenging current has a flow strength of at least approximately zero.

The use of the described controllable valve has the advantage that when there is a risk of the engine stalling, which could be caused by the fuel/air mixture being made too rich, the valve can simply be closed in order to reduce the proportion of fuel outgassing to zero in a simple and efficient way, and therefore counteract over-enrichment of the fuel/air mixture. This means that the probability of stalling of the engine or misdiagnoses in the fuel system diagnostics owing to heavy outgassing of fuel can be reduced.

According to a further exemplary embodiment, the method also has (a) determining a current capacity utilization rate of the internal combustion engine, wherein the method is carried out only if the current capacity utilization rate of the internal combustion engine is an average capacity utilization rate and/or (b) determining a current rotation speed of the internal combustion engine, wherein the method is carried out only if the current rotation speed of the internal combustion engine is within a medium rotational speed range.

Since the method described above and, in particular, the variation of the flow strength of the scavenging current necessary for it is carried out only in a partial load range or in a medium rotational speed range of the internal combustion engine, the probability of the operation of the internal combustion engine being adversely affected can be considerably reduced. In a medium load range or in a medium rotational speed range, an internal combustion engine usually in fact runs in a particularly stable way and the flow strength from the crank housing is relatively small in relation to the normal mass air flow of the internal combustion engine, with the result that short-term changes in the fuel/air mixture, caused by variation of the scavenging current, do not have any influence, or only have a negligible influence, on the stability of the operation of the internal combustion engine.

In this context, the expression "medium capacity utilization rate" can mean that the power currently made available by the internal combustion engine is higher than a lower power threshold and lower than an upper power threshold. In a corresponding way, the expression "medium rotational speed range" can mean that the current rotational speed of the internal combustion engine is greater than a predefined lower rotational speed threshold and lower than a predefined upper rotational speed threshold.

According to a further exemplary embodiment, a correlation characteristic diagram, which depends, inter alia, on a mass air flow of the internal combustion engine, is used to determine the quantity of outgassing of fuel.

The correlation characteristic diagram can preferably depend merely (a) on the difference described above between the first output value and the second output value and (b) on the current mass air flow. The correlation characteristic diagram can be stored, in particular, in an engine controller for the internal combustion engine.

According to a further exemplary embodiment, the first output value of the lambda controller is a mean value of a multiplicity of first individual output values which are made available by the lambda controller during a first time period within which the first scavenging current is present. In a corresponding way, the second output value of the lambda controller is a mean value of a multiplicity of second individual output values which are made available by the lambda controller during a second time period within which the second scavenging current is present.

The described formation of mean values has the advantage that fluctuations in the individual output values which occur under certain circumstances are averaged out at least with a certain probability. As a result, the accuracy of the described method can be considerably improved in order to determine the quantity of outgassing of fuel.

According to a further exemplary embodiment, the method also comprises (a) renewed setting of the first scavenging current, (b) measuring a further first output value of the lambda controller, (c) renewed setting of the second scavenging current and (d) measuring a further second output value of the lambda controller. In this context, the quantity of outgassing of fuel is also determined based on the measured further first output value and the measured further second output value. This means that, in order to determine the quantity of outgassing of fuel, at least two cycles of the scavenging current variation are passed through. In this way, the quantity of outgassing of fuel can be determined with a particularly high level of accuracy. Of course, this accuracy can be improved further by increasing the number of cycles.

As already explained above, the second scavenging current preferably has a flow strength of at least approximately zero. Furthermore, it is to be noted that, of course, the at least one further first output value and/or the at least one further second output value can also be determined by forming mean values of corresponding individual output values.

Other embodiments provide a method for adapting a lambda value for a fuel/air mixture which is to be burnt in an internal combustion engine during a lower load range and, in particular, during an idling mode is described. The described method comprises (a) operating the internal combustion engine in a medium load range and/or in a medium rotational speed range, (b) determining a value for the quantity of outgassing of fuel from a lubricant, which is located in a housing of an internal combustion engine, into an intake section of the internal combustion engine by means of a method according to one of the preceding claims, (c) estimating a correction value for future adaptation of the lambda value in a future operating state in which the internal combustion engine is operated in the lower load range, based on the specific value for the quantity of the outgassing of fuel, (d) operating the internal combustion engine in the lower load range, and (e) assigning a reliability level to the estimated correction value. If the reliability exceeds a predefined minimum reliability, the method also comprises (f) adapting the lambda value based on the estimated correction value. If the reliability does not exceed the predefined minimum reliability, the method also comprises (f) setting a third scavenging current through the housing, (g) measuring a third output value of the lambda controller, (h) setting a fourth scavenging current through the housing, wherein the fourth scavenging current has a different flow strength compared to the third scavenging current, (i) measuring a fourth output value of the lambda controller, and (j) adapting the lambda value based on the measured third output value and the measured fourth output value.

The described lambda value adaptation method is based on the realization that what is referred to as "pro-active determination" of a future correction value for a lambda controller in the lower load range is estimated based on determination of the quantity of outgassing of a fuel in a medium load range. As soon as the internal combustion engine is then in a lower load range and, in particular, in an idling range, suitable lambda value adaptation can therefore be carried out. The application of this pro-active determination or pro-active strategy has the advantage that the lambda controller can already carry out suitable lambda value adaptation or lambda value correction when the internal combustion engine enters the lower load range. It is therefore not necessary, after the entry of the internal combustion engine into the lower load range, to wait until the outgassing of fuel can be carried out in the lower load range before carrying out the lambda value adaptation.

However, if it is not possible to carry out the method described above for pro-active determination of the estimated correction value (for example because the internal combustion engine is not operated at all in the medium load range) or if a value for the quantity of outgassing of fuel which is determined with this method is not considered to be reliable (any more), "reactive determination" of the outgassing of fuel or of the effect thereof on the mixture formation in the lower load range of the internal combustion engine is carried out with the method described here for lambda value adaptation. According to some embodiments, this reactive strategy is also based on variation of the strength of the scavenging current, wherein the influence of the outgassing of fuel on a mixture formation is determined from the respective (third or fourth) output value of the lambda controller, and the necessary adaptation of the lambda value in the lower load range is therefore determined.

It is to be noted that the third scavenging current can have the same flow strength as the abovementioned first scavenging current. In addition, the setting of the third scavenging current can also include retaining the current value for the scavenging current when the internal combustion engine enters the lower load range. In addition, the fourth scavenging current can, under certain circumstances, have the same flow strength as the abovementioned second scavenging current. In particular, the fourth scavenging current can have a flow strength of at least approximately zero.

It is also to be noted that within the scope of the reactive determination of the outgassing of fuel the difference between the two output values, i.e. the difference between the third output value and the fourth output value, can also easily be used, to determine, if appropriate by using a predetermined characteristic diagram, the suitable adaptation of the lambda value after the transition into the lower load range of the internal combustion engine.

Furthermore, it is to be noted that in addition to the described lambda value adaptation the scavenging current can also be interrupted or heavily throttled (for example by closing the abovementioned controllable valve), with the result that outgassing of fuel, which is fed to the combustion process via the intake section of the internal combustion engine, can be reliably avoided, and therefore undesired over-enrichment of the fuel/air mixture to be burnt can be prevented. In this way, the risk of stalling of the internal combustion engine can be reduced and a fault in the fuel system diagnostics can be avoided.

The specified correction value can constitute a difference value or a factor with which a lambda value which is firstly determined by the lambda controller is modified in order to achieve, after entry into the lower load range or into the idling range, optimum setting of the mixture formation of the fuel/air mixture which takes into account the outgassing.

According to one exemplary embodiment, the adaptation of the lambda value includes, if the absolute value of the estimated correction value is lower than a predefined first threshold, retaining the lambda value which is made available by the lambda controller for the lower load range without taking into account the outgassing of fuel. This can mean that the lambda control adaptation with which outgassing of fuel is to be at least partially compensated is not carried out until this adaptation would also actually result in a certain minimum change in the lambda value made available by the lambda controller for the lower load range without taking into account the outgassing of fuel.

According to a further exemplary embodiment, the adaptation of the lambda value comprises, if the absolute value of the estimated correction value is at least as large as the first threshold but lower than a predefined second threshold, modification of the lambda value, made available by the lambda controller for the lower load range, based on the estimated correction value. This can mean that the lambda controller is effectively relieved of loading because it does not have to compensate the change in the mixture formation of the fuel/air mixture which is due to the outgassing of fuel from the housing. As a result, the entire lambda control is stabilized and the lambda controller can be prevented from effectively "running into the buffers" owing to outgassing of fuel.

This can mean that when there is a risk of stalling of the engine at the transition of the internal combustion engine into the lower load range, which risk is assumed if the estimated correction value is at least as large in absolute terms as the first threshold, a suitable change, in particular shifting, of the lambda value is performed.

According to a further exemplary embodiment, the modification of the lambda value, made available by the lambda controller for the lower load range, based on the estimated correction value is carried out in such a way that when the operating state of the internal combustion engine approaches the lower load range, an ever larger portion of the estimated correction value is taken into account in the adaptation of the lambda value.

Therefore, as the lower load state is increasingly approached, the correction value can be included, for example in the form of a ramp, in the calculation for the lambda adaptation. This has the advantage that a sudden lambda value adaptation is avoided and as a result the stability of the open-loop or closed-loop control of the operation of the internal combustion engine is increased.

According to a further exemplary embodiment, if the absolute value of the estimated correction value is at least as high as the second threshold, the method also has at least partial blocking of the scavenging current through the housing. Whether, in this case, the modification, described above, of the lambda value which is made available by the lambda controller for the lower load range without taking into account the outgassing of fuel is additionally performed can be decided depending on the specific application. However, it is to be noted that the lambda value adaptation or the change in the lambda value should not assume larger values than are suggested by the estimated correction value described above. Otherwise, in fact the lambda adaptation could prevent a system error which, under certain circumstances, occurs in the mixture formation at the same time, from being detected by a known fuel diagnosis. Such system errors, which should be detected without fail, are, for example, a hole in the intake manifold, blockage of an air filter, a blocked injection valve arranged in the intake section, etc.

It is to be noted that the two thresholds which are described preferably have a negative value. This is due to the fact that the lambda controller generally has to make available a more negative output value in order to prevent enrichment or over-enrichment of the fuel/air mixture owing to outgassing of fuel.

According to a further exemplary embodiment, the reliability of the estimated correction value decreases with increasing time which has passed since the execution of the method for determining the quantity of the outgassing of a fuel from the lubricant. This has the advantage that the reliability can easily be defined by measuring the time since the last execution of the method for determining the quantity of outgassing of fuel from the lubricant and, as explained above, can be assigned to the respective estimated correction value.

According to a further embodiment, an internal combustion engine from a motor vehicle is described. The described internal combustion engine comprises (a) a housing, in particular a crank casing, (b) a ventilation system for the housing, (c) a valve which can be actuated electrically and which is arranged on the ventilation system in such a way that a scavenging current through the crank casing can be set actively, and (d) a control device which is configured in such a way that (d1) the method described above for determining the quantity of outgassing of fuel from a lubricant, which is located in a housing of an internal combustion engine, into an intake section of the internal combustion engine, can be carried out, and/or (d2) the method described above for adapting a lambda value for a fuel/air mixture which is to be burnt in the internal combustion engine during a lower load range and, in particular, during an idling mode, can be carried out.

The described internal combustion engine is also based on the realization that selectively varying the strength of the scavenging current also makes it possible to vary the quantity of fuel which results from outgassing from the lubricant and which is then introduced into the intake section of the internal combustion engine. A lambda controller of the internal combustion engine will then react to the different quantities of outgassing of fuel or fuel outgassing rates in a different way as a result of adaptation of its output value in order to optimize, with respect to optimum combustion, the lambda value of the fuel/air mixture to be burnt, with the result that the two resulting output values constitute reliable information about the quantity or rate of outgassing of fuel.

Insofar as the internal combustion engine or the control device thereof also immediately ensures suitable lambda value adaptation at the transition of the internal combustion engine from an at least medium load range into a lower load range and, in particular, into the idling range, the described internal combustion engine is based on the realization that what is referred to as "pro-active determination" of a future correction value for a lambda controller in the lower load range can be estimated based on a determination of the quantity of outgassing of a fuel in a medium load range.

However, if it is not possible to carry out pro-active determination of the correction value in the medium load range or if a correction value which is acquired by means of the pro-active determination is not considered to be reliable (anymore), in the method described here for lambda value adaptation the outgassing of fuel or the effect thereof on the mixture formation in the lower load range of the internal combustion engine is "determined reactively". This reactive strategy is also based on variation of the strength of the scavenging current, wherein the influence of the outgassing of fuel on the mixture formation is determined from the respective (third or fourth) output value of the lambda controller, and in this way the necessary adaptation of the lambda value in the lower load range is determined.

Other embodiments provide a computer program is described (a) for determining the quantity of outgassing of fuel from a lubricant, which is located in a housing of an internal combustion engine, into an intake section of the internal combustion engine and/or for adapting a lambda value. The described computer program is, when it is executed by a processor, configured to carry out the methods described above.

According to this document, the designation of such a computer program is equivalent to the term of a program element, a computer program product and/or a computer-readable medium which contains instructions for controlling a computer system in order to coordinate the method of operation of a system or of a method in a suitable way, in order to obtain the effects which are associated with the disclosed method.

The computer program can be implemented as a computer-readable instruction code in any suitable programming language such as, for example, in JAVA, C++ etc. The computer program can be stored on a computer-readable storage medium (CD-Rom, DVD, Blue-ray disk, interchangeable disk drive, volatile or non-volatile memory, built-in memory/processor etc.). The instruction code can program a computer or other programmable devices such as, in particular, a control unit for an internal combustion engine of a motor vehicle, in such a way that the desired functions are executed. In addition, the computer program can be made available in a network such as, for example, the Internet, from which it can be downloaded by a user when necessary.

Embodiments of the present disclosure can be implemented by means of a computer program, i.e. by means of software, as well as by means of one or more special electric circuits, i.e. in hardware or in any desired hybrid form, i.e. by means of software components and hardware components.

It is to be noted that various embodiments have been described with reference to different inventive aspects. In particular, a number of embodiments are described with device claims and other embodiments are described with method claims. However, when a person skilled in the art reads this application, it should immediately be clear to said person that, unless specifically stated otherwise, any desired combination of features associated with different inventive aspects is possible.

Further advantages and features of the disclosed subject matter emerge from the following description of example embodiments. The individual figures of the drawing of this application are to be considered merely as schematic and are not true to scale.

According to the exemplary embodiment described here, a pro-active and, if necessary, a reactive strategy are applied to deal with the risk of stalling of the engine or to deal with the risk of misdiagnoses in the fuel system diagnosis. The closing of a controllable valve, with which the flow strength of a scavenging current through a crank casing of an internal combustion engine can be set, or the activation of a lambda adaptation in respect to outgassing of fuel is carried out here as a function of the risk assessment. The pro-active strategy is, as far as possible, always applied with preference because the pro-active strategy permits a lambda adaptation which at least partially compensates the outgassing of fuel to be carried out even before, or at least at the latest at, the start of an idling phase of the internal combustion engine. With the pro-active strategy it is therefore possible to act in a predictive fashion before it is possibly too late. Since the pro-active strategy cannot always be utilized, it does not exclude the reactive strategy but only adds to it.

FIG. 1 shows a flowchart for selecting between the pro-active strategy and the reactive strategy. Within the scope of this selection it is firstly checked whether, in the active driving cycle, the quantity of outgassing of the fuel which has an influence on the mixture formation of the fuel-air mixture was already determined in the current driving cycle. Insofar as this determination is carried out for the purpose of stability of the operation of the internal combustion engine only in a medium load range or in a partial load range of the internal combustion engine, it is then, in particular, not possible for an indicative value for the quantity of outgassing of the fuel to be present if the internal combustion engine has not yet been operated in the partial load range in the current driving cycle.

Furthermore, within the scope of this selection it is checked whether the reliability of a value for the quantity of outgassing of the fuel in the partial load range for the purpose of predicting outgassing of a fuel or necessary lambda value adaptation in a possibly imminent idling range of the internal combustion engine, exceeds a predefined minimum reliability level. According to a further exemplary embodiment, the reliability decreases as the time which has passed since the determination of the outgassing of fuel progresses. Only when both of the abovementioned questions are answered positively, i.e. there is a reliable value available for the outgassing of fuel in the partial load range, is the pro-active strategy indicated at the transition of the internal combustion engine into the idling range. Otherwise, the reactive strategy is applied at the transition of the internal combustion engine into the idling range.

Figure 2:
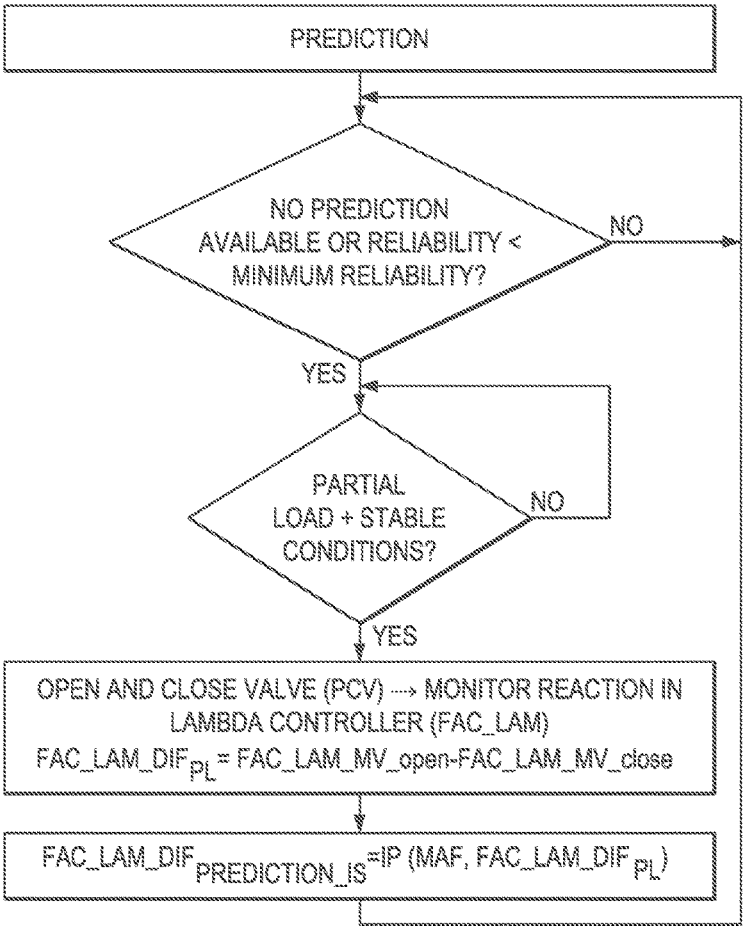
FIG. 2 shows a flowchart of the determination of a prediction value for suitable lambda adaptation in a coming idling phase of the internal combustion engine.

FIG. 2 shows a flowchart of the pro-active determination of a prediction value for suitable lambda adaptation in a coming idling phase of the internal combustion engine. According to the exemplary embodiment illustrated here, the determination is carried out only if (a) no prediction values are available Or if the reliability thereof is less than a predefined minimum reliability level and if (b) the internal combustion engine is operated under partial load in a stable phase. If these conditions (a) and (b) are met, the controllable value, which is also referred to below as a crank casing ventilation valve (Positive Crank Valve, PCV) or simply as a ventilation valve, is closed and opened for an applicable number of cycles. A resulting lambda controller mean value FAC_LAM_MV_open or FAC_LAM_MV_close is formed during the resulting "valve open" and/or "valve closed" phases and respectively after a transient recovery time. These lambda controller mean values are each a measure of the intervention intensity of the lambda controller which attempts to generate a fuel/air mixture which is optimum for the combustion. The difference between the two values FAC_LAM_MV_open and FAC_LAM_MV_close is then a measure of the influence of the opening and respective closing of the ventilation valve on the mixture formation in the partial load range.

$$FAC_LAM_DIF_{PL}=FAC_LAM_MV_\text{open}-FAC_LAM_MV_\text{close} \quad (1)$$

With the aid of this difference $FAC_LAM_DIF_{PL}$ and the realization that the detected outgassing of fuel and the influence of the mixture in the partial load (PL) correlates to the outgassing or the influence of the mixture during a chronologically close idling phase (Idle Speed, IS), it is possible to make a prediction for the expected lambda adaptation $FAC_LAM_DIF_{Prediction_IS}$ in response to outgassing in the idling mode:

$$FAC_LAM_DIF_{Prediction_IS}=IP(MAF,FAC_LAM_DIF_{PL}) \quad (2)$$

In this context, IP is a correlation characteristic diagram which has to be determined once per system and which depends on the current mass air flow (MAF).

Figure 3:
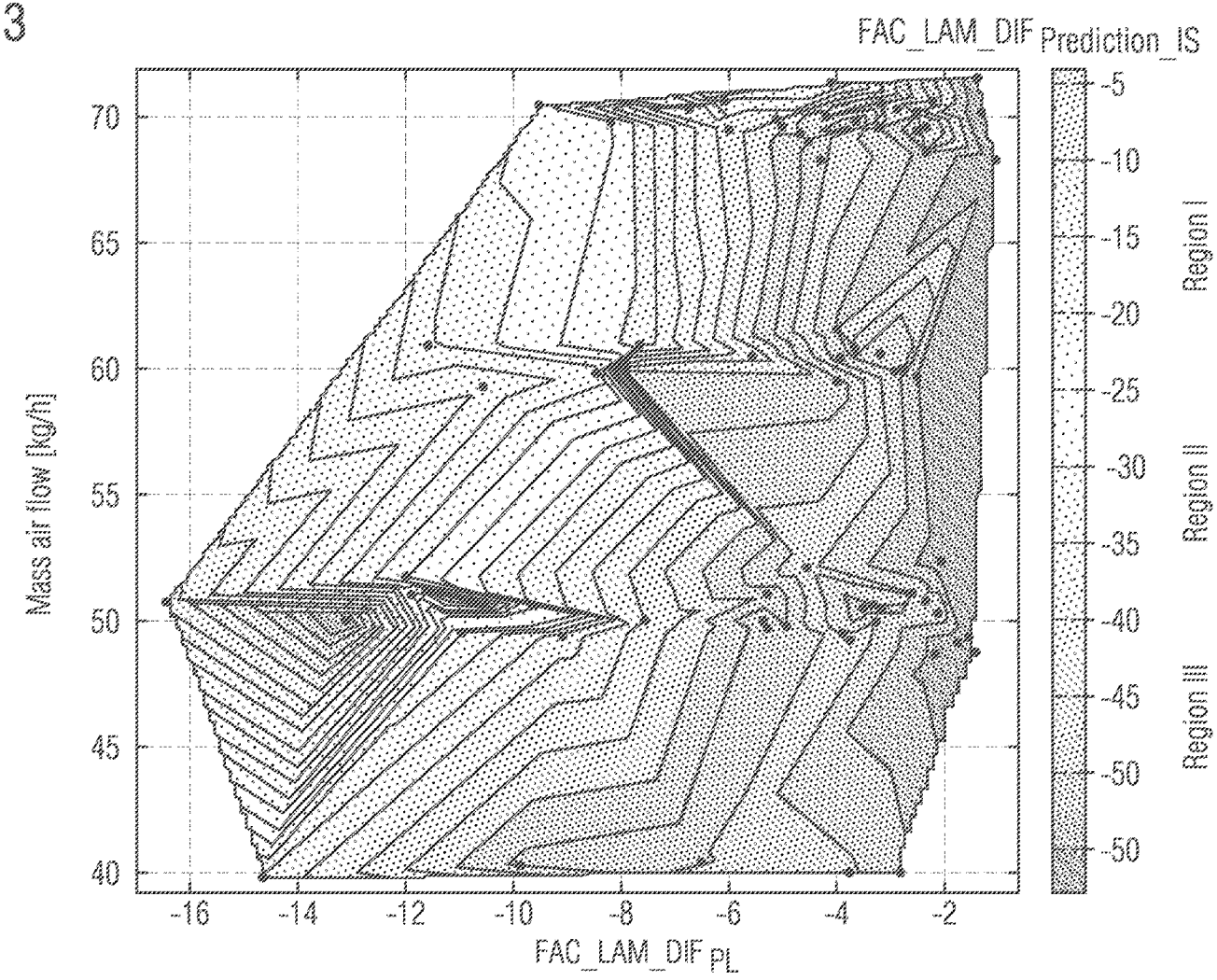
FIG. 3 shows a correlation characteristic diagram which, as a function of the lambda controller difference value $FAC_LAM_DIF_{PL}$ and a mass air flow MAF, supplies a prediction value $FAC_LAM_DIF_{Prediction_IS}$ for the expected outgassing in the idling mode of the internal combustion engine.

FIG. 3 shows an exemplary correlation characteristic diagram. The values for $FAC_LAM_DIF_{Prediction_IS}$ are represented as grey shading. According to the exemplary embodiment illustrated here, the dark shading in the right-hand region of the illustrated characteristic diagram corresponds to prediction values $FAC_LAM_DIF_{Prediction_IS}$ of approximately −5 to approximately −20. The comparatively bright shading in the middle region of the characteristic diagram which extends slightly obliquely corresponds to prediction values $FAC_LAM_DIF_{Prediction_IS}$ of approximately −15 to approximately −40. The shading which is illustrated in dark again in the left-hand region of the illustrated characteristic diagram corresponds to prediction values $FAC_LAM_DIF_{Prediction_IS}$ of approximately −35 to −55.

By means of this information about $FAC_LAM_DIF_{Prediction_IS}$, acquired with the aid of the characteristic diagram IP, it is decided whether or not there is a risk of the internal combustion engine stalling in a subsequent idling mode owing to over-enrichment, which is due to expected outgassing of fuel. Insofar as $FAC_LAM_DIF_{Prediction_IS}$ is lower than a first threshold 1, at least a certain risk of stalling of the engine is assumed and the lambda controller is already shifted or relieved (shortly) before the entry into the idling mode, by the value $FAC_LAM_DIF_{Prediction_IS}$ determined by means of the characteristic diagram IP (crank casing lambda adaptation). According to the exemplary embodiment illustrated here, this is done by means of a ramp with respect to time in the form such that, as the idling mode is approached, a greater proportion of $FAC_LAM_DIF_{Prediction_IS}$ is included in the calculation of the lambda adaptation.

If the value for $FAC_LAM_DIF_{Prediction_IS}$ is lower than a second threshold 2, which is in turn lower than the first threshold 1, it can be advantageous for the operating stability of the internal combustion engine to completely close the valve, instead of shifting the lambda controller, in order to reduce the risk of stalling of the engine.

It is to be noted that both the threshold 1 and the threshold 2 are negative since $FAC_LAM_DIF_{Prediction_IS}$ is negative during outgassing of fuel. This is due to the fact that when a valve is open the lambda controller must adjust in the lean direction to a greater degree than in the case of a closed valve.

Three different risk classes for stalling of the engine in a future idling phase are illustrated in FIG. 3. In a first region I, which is present in the right-hand part of the characteristic diagram, the value of $FAC_LAM_DIF_{Prediction_IS}$ is substantially higher than the threshold 1 (in absolute terms the value is lower than the absolute value of the threshold 1). Here, the probability of stalling of the engine is considered to be very small. Crank casing lambda adaptation is considered to be unnecessary. A second region II, which is located in the central part of the characteristic diagram, is defined by the condition threshold 1>$FAC_LAM_DIF_{Prediction_IS}$>threshold 2. Here, at least a certain probability of stalling of the engine is assumed and corresponding crank casing lambda adaptation is carried out on entry into the idling phase. A third region III, which is located in the left-hand part of the characteristic diagram, is defined by the condition $FAC_LAM_DIF_{Prediction_IS}$<threshold 2. According to the exemplary embodiment illustrated here, the lambda controller is not shifted, and instead the valve is completely closed.

According to the exemplary embodiment illustrated here, the crank casing lambda adaptation is also prevented from being able to assume values larger than $FAC_LAM_DIF_{Prediction_IS}$. Otherwise, the crank casing lambda adaptation could in fact prevent a fuel system error which occurs possibly at the same time in a fuel diagnostic system (Fuel System Diagnosis, FSD) from being reliability detected. Such system errors, which should be detected in all cases, are, for example, a hole in the intake manifold, blockage of an air filter and/or a blocked injection valve.

Owing to the continuous outgassing of fuel from the lubricant and/or the oil of the crank casing and the quantity of fuel in the lubricant and/or oil which is continuously changed as a result, a prediction which is made is valid for only a limited time. The validity or the reliability of the prediction can be assessed by means of a reliability value, which can also be referred to as a "confidence integral". According to the exemplary embodiment illustrated here, the reliability value or the confidence integral directly after a prediction has the value 100% (full reliability) and decreases continuously with time. If the reliability value is below a minimum reliability level which is dependent on the respective application, there can no longer be any confidence in the prediction. In this case, a new determination of $FAC_LAM_DIF_{Prediction_IS}$ is necessary before the pro-active strategy described above can be applied again.

It is to be noted that the degree of decrease in the reliability over time and/or the value of the minimum reliability can depend on the respective application. In this context, in particular the oil temperature is an important parameter which determines the selection of suitable values for the specified variables.

Figure 4:
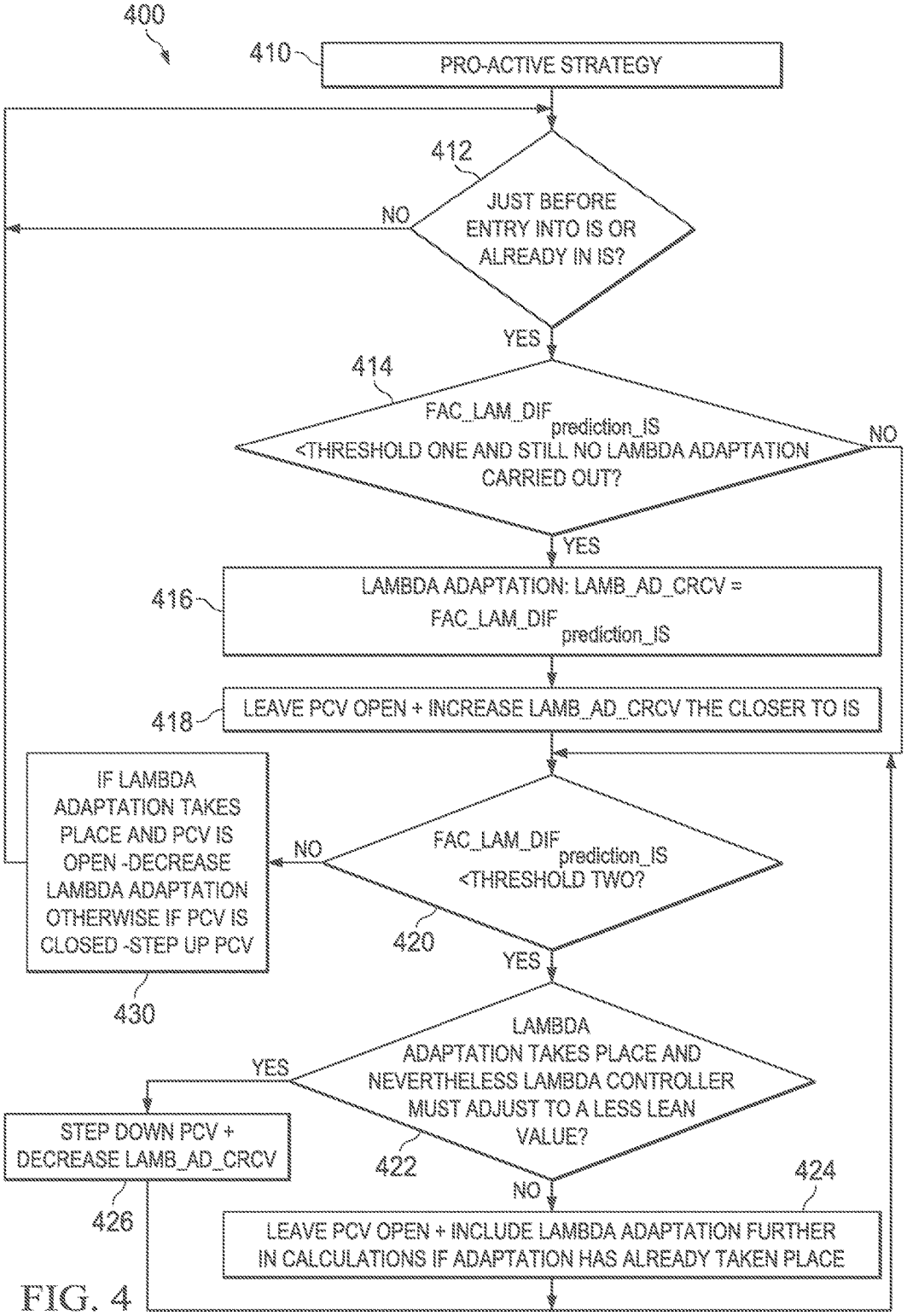
FIG. 4 shows a flowchart of the application or execution of a pro-active strategy according to a preferred exemplary embodiment.

FIG. 4 shows a flowchart 400 for the application or execution of a pro-active strategy according to a preferred exemplary embodiment. It is to be noted that other specific implementations of a pro-active strategy are also possible.

The pro-active strategy starts with a step 410. Afterwards, in a step 412 it is checked whether the internal combustion engine is already just about to enter into an idling state (IS) or is already in the idling mode. If this is the case, in a step 414 it is checked whether a prediction value $FAC_LAM_DIF_{Prediction_IS}$, which is already determined in advance, for the lambda adaptation (cf. FIG. 2) at a transition into the idling mode is lower, i.e. more negative, than a first threshold 1. If this is the case and if no lambda adaptation has been carried out either, a step 416 follows, otherwise the pro-active strategy is carried on with a step 420.

In the step 416, an adaptation value or shifting of the lambda value by a value LAMB_AD_CRCV is then calculated based on the outgassing of fuel from the crankshaft casing, which is added by a crankshaft ventilation system (Crank-Case Ventilation, CRCV) to the fuel/air mixture to be burnt. In this context, the value LAMB_AD_CRCV is equal to the previously determined value $FAC_LAM_DIF_{Prediction_IS}$.

Afterwards, in a step 418 when the valve continues to be open, the value LAMB_AD_CRCV is included as a ramp as a function of the time as the idling operating state is progressively approached. This means that the value LAMB_AD_CRCV in the case of the lambda adaptation is initially not yet taken into account, is increasingly taken into account as the idling state is approached, and is fully taken into account when the idling mode is reached. In this context, the reason for the lambda controller adjusting to a much leaner value may be outgassing of a fuel from the crankshaft casing or additionally a fault in the fuel diagnostic system (Fuel System Diagnosis, FSD).

Then, in the step 420 already mentioned above it is checked whether the prediction value $FAC_LAM_DIF_{Prediction_IS}$ for the lambda adaptation (cf. FIG. 2) is lower, i.e. more negative than a second threshold 2 in the case of a transition into the idling mode. If this is the case, in a step 422 an interrogation follows as to whether (a) lambda adaptation is taking place and whether (b) the lambda controller nevertheless continues to adjust to a highly lean value. If at least one of these two questions (a) and (b) receives a negative response, in a step 424 the controllable valve continues to be left open and, if the lambda adaptation has already taken place, the lambda adaptation continues to be included in the calculation. If the two questions (a) and (b) receive a positive response in step 422, according to the exemplary embodiment illustrated here the controllable valve is closed (adjusted up the ramp) and the abovementioned value LAMB_AD_CRCV is adjusted down the ramp. The controllable valve is therefore closed in this context because it cannot be excluded that the reason for the strong adjustment of the lambda controller in the lean direction was possibly an error in a fuel diagnostic system (Fuel System Diagnosis, FSD).

As is apparent from FIG. 4, the step 420 again follows both the step 424 and the step 426.

If it is detected in this step 420 again that the prediction value $FAC_LAM_DIF_{Prediction_IS}$ continues to be lower, i.e. more negative, than a second threshold 2, the abovementioned steps 422 and 426 or 426 are carried out again. However, if it is detected that the prediction value $FAC_LAM_DIF_{Prediction_IS}$ has in the meantime become higher, i.e. less negative, than the second threshold 2, the pro-active strategy described here is continued with a step 430. This will generally be the case when the internal combustion engine is no longer operated in the idling mode but instead in the meantime in a partial load range.

In the step 430 it is then checked whether a lambda adaptation is carried out and whether the controllable valve is opened. If both are the case, the lambda adaptation is reduced, that is to say over time the value LAMB_AD_CRCV is taken into account less and less. If the controllable valve is closed, said valve is stepped up, i.e. slowly opened.

Afterwards, the pro-active strategy is continued with the step 412 which has already been explained above.

If it has not yet been possible to make a prediction in the current driving cycle (DC) or the confidence integral has expired, the pro-active strategy for preventing stalling of the engine in the idling mode cannot be used. In this case, the reactive strategy is implemented.

The reactive strategy detects, when entering into the idling mode, that the lambda controller must adjust to a much leaner value. On this basis, the controllable ventilation valve is firstly closed. In this context, the difference between the intervention of the lambda controller in the "ventilation valve open" state and the intervention of the lambda controller in the "ventilation valve closed" state is determined.

$$FAC_LAM_DIF_{IS}=FAC_LAM_MV_\text{open}-\text{FAC}_LAM_MV_\text{close} \quad (3)$$

If $FAC_LAM_DIF_{IS}$ is lower than a predefined threshold value, outgassing of fuel is concluded as the reason for the adjustment to a much leaner value in the lambda controller. Otherwise, a fuel system error is assumed and the ventilation valve is opened again for the detection of faults. In the case of a detected risk of stalling of the engine, in a way analogous to the pre-active strategy, either (a) the lambda controller is shifted or relieved by the determined $FAC_LAM_DIF_{IS}$ (crank casing lambda adaptation) and the ventilation valve remains open or (b) the ventilation valve is additionally closed.

According to the exemplary embodiment illustrated here, in the case of the reactive strategy too the crank casing lambda adaptation is again prevented, in a way corresponding to the pro-active strategy explained above, from being able to assume larger values than $FAC_LAM_DIF_{IS}$.

Figure 5:
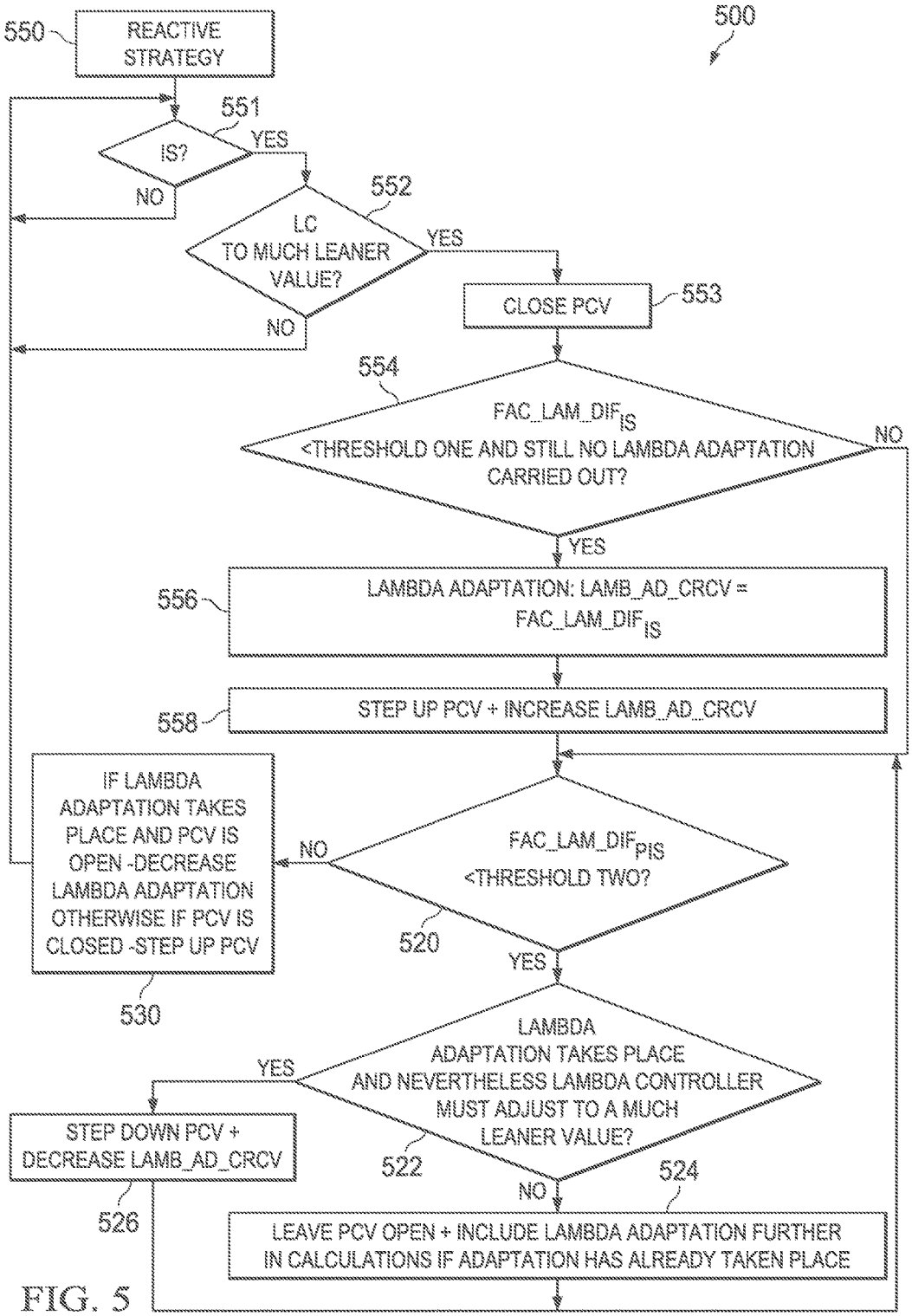
FIG. 5 shows a flowchart of the application or execution of a reactive strategy according to a preferred exemplary embodiment.

FIG. 5 shows a flowchart 500 for the application or execution of a reactive strategy according to a preferred exemplary embodiment. It is to be noted that in this case other specific implementations of a reactive strategy are also possible.

The reactive strategy starts with a step 550. Afterwards, in a step 551 it is checked whether the internal combustion engine is already in the idling mode (IS). If this is not the case, the step 551 is carried out again until the internal combustion engine is in the idling mode. Afterwards, in a step 552 it is interrogated whether the lambda controller (Lambda Control, LC) intervenes in the mixture formation with adjustment to a much leaner value. If this is not the case, the step 551 is carried out again. If this is the case, the controllable ventilation valve (Positive Crank Valve, PCV) is closed in a subsequent step 553.

Afterwards, in an interrogation step 554 it is checked whether (a) the difference value $FAC_LAM_DIF_{IS}$ which is explained above is lower (i.e. more negative) than a first threshold 1 and whether (b) a lambda adaptation has still not been carried out. If these two questions (a) and (b) receive a positive response, a step 556 is subsequently carried out. If at least one of the two questions (a) and (b) receives a negative response, a step 520 follows.

In the step 556, an adaptation value or shifting of the lambda value by a value LAMB_AD_CRCV is then calculated based on the outgassing of fuel from the crankshaft casing, which outgassing is added via a crankshaft ventilation system (Crank-Case Ventilation, CRCV) to the fuel/air mixture to be burnt. In this context, the value LAMB_AD_CRCV is equal to the value $FAC_LAM_DIF_{IS}$. Afterwards, in a step 558 the controllable valve is slowly opened (stepped up) and at the same time the value LAMB_AD_CRCV is increased as a function of the time. In this context, the reason for the adjustment of the lambda controller in a much leaner direction can be outgassing of a fuel from the crankshaft casing or additionally a fault in a fuel diagnostic system (Fuel System Diagnosis, FSD).

The step 520 corresponds to the step 420 which is carried out in the pro-active strategy, wherein the value $FAC_LAM_DIF_{IS}$, which was already actually measured in the idling mode, is merely used instead of the prediction value $FAC_LAM_DIF_{Prediction_IS}$. In addition, the following steps 522, 524, 526 and 530 correspond to the steps 422, 424, 426 and 430 of the pro-active strategy illustrated in FIG. 4. In order to avoid unnecessary repetitions, a detailed description of steps 522, 524, 526 and 530 is therefore dispensed with and instead reference is made to the above description of steps 422, 424, 426 and 430.

In summary our conclusions are as follows: with this document a method for adapting a lambda value for a fuel/air mixture which is to be burnt in an internal combustion engine during an idling mode is described. In this context, what is referred to as a pro-active strategy for determining the risk of stalling of an engine or for avoiding misdiagnoses in the fuel system diagnostics is described. In this context, a resulting lambda controller difference in the idling mode is inferred (prediction) from a difference, measured at partial load, of the lambda controller interventions when the ventilation valve is opened and when said valve is closed. In addition, a crank casing lambda adaptation is described, which has a limitation which depends in turn on the currently present quantity of outgassing $FAC_LAM_DIF_{IS}$ and the respectively expected quantity of outgassing $FAC_LAM_DIF_{Prediction_IS}$. As a result it is possible to separate a fuel system error from outgassing of a fuel since, as long as the fuel diagnostic system is operational, the crank casing lambda adaptation can never assume values larger than $FAC_LAM_DIF_{IS}$ or respectively $FAC_LAM_DIF_{Prediction_IS}$.

The invention claimed is:

1. A method for controlling an internal combustion engine, comprising:

determining a quantity of outgassing of a fuel from a lubricant, which is located in a housing of an internal combustion engine, into an intake section of the internal combustion engine, by:

setting a first scavenging current through the housing, measuring a first output value of a lambda controller of the internal combustion engine, setting a second scavenging current through the housing, wherein the second scavenging current has a different flow strength compared to the first scavenging current, measuring a second output value of the lambda controller of the internal combustion engine, and determining the quantity of outgassing of the fuel based on the measured first output value and the measured second output value, and controlling an operation of the internal combustion engine based on the determined quantity of the outgassing of fuel.

2. The method of claim 1, wherein the quantity of outgassing of a fuel is determined based on a difference between the first output value and the second output value.

3. The method of claim 1, wherein the second scavenging current has a flow strength of at least approximately zero.

4. The method of claim 1, wherein at least one of the first scavenging current and the second scavenging current is set by a controllable valve.

5. The method of claim 1, further comprising:

determining a current capacity utilization rate of the internal combustion engine, and determining the quantity of outgassing of a fuel in response to determining that the current capacity utilization rate of the internal combustion engine is an average capacity utilization rate.

6. The method of claim 1, comprising determining the quantity of outgassing of fuel based on a correlation characteristic diagram defining a function of a mass air of flow rate of the internal combustion engine.

7. The method of claim 1, wherein the first output value of the lambda controller is a mean value of a multiplicity of first individual output values provided by the lambda controller during a first time period within which the first scavenging current is present.

8. The method of claim 1, further comprising:

performing a renewed setting of the first scavenging current, measuring a further first output value of the lambda controller, performing a renewed setting of the second scavenging current, and measuring a further second output value of the lambda controller, wherein the quantity of the outgassing of fuel is also determined based on the measured further first output value and the measured further second output value.

9. The method of claim 1, further comprising:

determining a current rotation speed of the internal combustion engine, determining the quantity of outgassing of a fuel in response to determining that the current rotation speed of the internal combustion engine is within a medium rotational speed range.

10. The method of claim 1, wherein:

the first output value of the lambda controller is a mean value of a multiplicity of first individual output values which are made available by the lambda controller during a first time period within which the first scavenging current is present, and the second output value of the lambda controller is a mean value of a multiplicity of second individual output values which are made available by the lambda controller during a second time period within which the second scavenging current is present.

* * * * *